US008673181B2

(12) United States Patent
Gualy et al.

(10) Patent No.: US 8,673,181 B2
(45) Date of Patent: Mar. 18, 2014

(54) SYSTEMS AND METHODS FOR STARTING UP A GASIFIER

(75) Inventors: Ron Gualy, Katy, TX (US); John Abughazaleh, Sugar Land, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 335 days.

(21) Appl. No.: 13/207,630

(22) Filed: Aug. 11, 2011

(65) Prior Publication Data

US 2013/0037750 A1 Feb. 14, 2013

(51) Int. Cl.
*C01B 3/02* (2006.01)
*C01B 3/32* (2006.01)
*C01B 3/34* (2006.01)

(52) U.S. Cl.
USPC ..... 252/373; 48/197 R

(58) Field of Classification Search
USPC ..... 252/373; 431/6; 48/197 R
See application file for complete search history.

(56) References Cited

U.S. PATENT DOCUMENTS 3,920,417 A 11/1975 Fernandes
4,007,017 A * 2/1977 Slater et al. ..... 48/197 R
4,007,018 A * 2/1977 Slater et al. ..... 48/197 R
4,007,019 A * 2/1977 Slater et al. ..... 48/197 R
4,010,092 A 3/1977 Deering
4,290,779 A 9/1981 Qadar
4,328,007 A 5/1982 Rafael
4,355,586 A 10/1982 Brown
4,378,974 A 4/1983 Petit et al.
4,385,906 A * 5/1983 Estabrook ..... 48/197 R
4,400,180 A 8/1983 Marion et al.
4,809,624 A 3/1989 Van Der Burgt
4,881,947 A 11/1989 Parker
4,881,949 A * 11/1989 Brungel et al. ..... 48/197 R
5,087,271 A 2/1992 Stellaccio et al.
5,145,491 A 9/1992 Schmitt et al.
6,033,447 A 3/2000 Moock et al.
6,174,161 B1 1/2001 Slavejkov et al.
6,908,572 B1 * 6/2005 Derbyshire et al. ..... 252/502
7,604,400 B2 10/2009 Thompson et al.
2006/0101715 A1 5/2006 Vlok et al.
2008/0056971 A1 3/2008 Hughes
2009/0178338 A1 7/2009 Leininger et al.
2009/0188165 A1 7/2009 Ariyapadi et al.
2010/0044643 A1 * 2/2010 Wallace ..... 252/373
2010/0180503 A1 7/2010 Yokohama
2010/0181539 A1 * 7/2010 Apanel et al. ..... 252/373
2010/0213418 A1 * 8/2010 Logan et al. ..... 252/373
2011/0016789 A1 1/2011 Nukumi
2011/0120012 A1 * 5/2011 Balmas et al. ..... 48/197 R
2011/0210292 A1 * 9/2011 Ariyapadi et al. ..... 252/373

(Continued)

*Primary Examiner* — Wayne Langel
(74) *Attorney, Agent, or Firm* — Gary M. Machetta

(57) ABSTRACT

Systems and methods for starting a gasifier are provided. In the method, a heated start-up medium can be fed to a gasifier operating at a first temperature. Heat can be transferred from the heated start-up medium to the gasifier to increase the temperature of the gasifier from the first temperature to an intermediate temperature sufficient to auto-ignite a start-up fuel. A start-up fuel and an oxidant can be fed to the gasifier after the temperature within the gasifier is increased to the intermediate temperature. At least a portion of the start-up fuel can be combusted within the gasifier to produce a combustion gas. Heat can be transferred from the combustion gas to the gasifier to increase the temperature of the gasifier to an operating temperature, wherein the operating temperature is sufficient to gasify at least a portion of a hydrocarbon feedstock.

20 Claims, 1 Drawing Sheet

(56) References Cited

U.S. PATENT DOCUMENTS

2012/0256131 A1* 10/2012 Ko et al. ..... 252/373
2012/0267575 A1* 10/2012 Abughazaleh ..... 252/373
2012/0280181 A1* 11/2012 Ruger et al. ..... 252/373

* cited by examiner

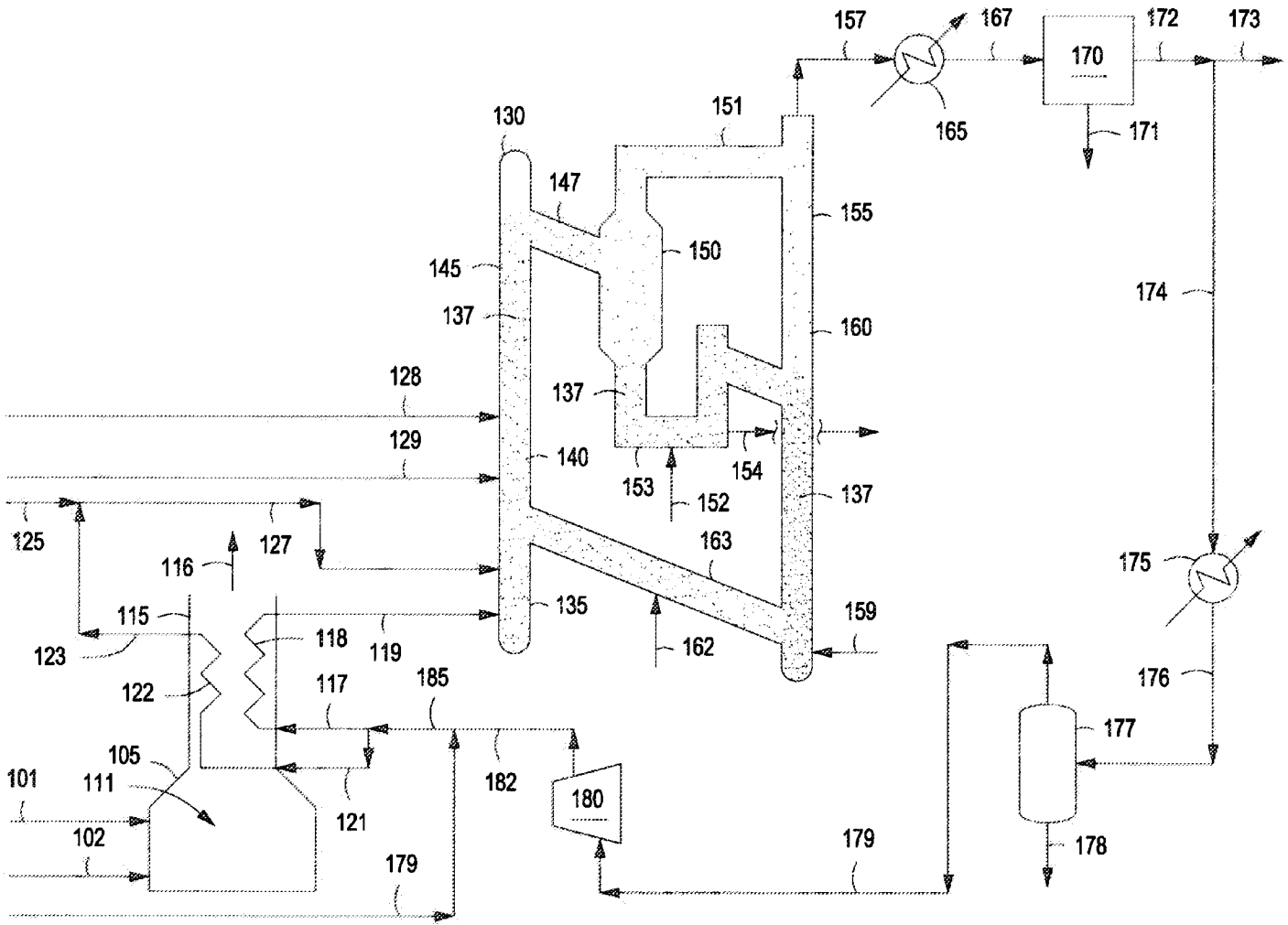
173
172
170
171
167
165
157
174
175
176
177
178
179
155
160
137
159
151
150
154
152
163
162
153
147
137
140
135
130
145
137
180
182
185
128
129
119
179
118
117
121
127
116
115
122
105
111
102
123
125
101

SYSTEMS AND METHODS FOR STARTING UP A GASIFIER

BACKGROUND

1. Field

Embodiments described generally relate to methods for starting up a gasifier. More particularly, such embodiments relate to transitioning a gasifier from an initial or starting state to a steady or operating state.

2. Description of the Related Art

Gasification is a high-temperature process usually conducted at elevated pressure to convert carbon-containing materials into carbon monoxide and hydrogen gas. Since this gas is often used for the synthesis of chemicals or synthetic hydrocarbon fuels, the gas is often referred to as "synthesis gas" or "syngas." Typical feeds to gasification processes include petroleum-based materials that are neat or residues of processing materials, such as heavy crude oil, coals, bitumen recovered from tar sands, kerogen from oil shale, coke, and other high-sulfur and/or high metal-containing residues; gases; and various carbonaceous waste materials. The feedstock materials can be reacted in the gasifier in a reducing (oxygen-starved) atmosphere at high temperature and (usually) high pressure. The resulting syngas typically contains about 85 percent of the feedstocks carbon content as carbon monoxide, with the balance being a mixture of carbon dioxide and methane.

To start the gasifier, a separate start-up heater is typically used to combust a start-up fuel to produce a combustion gas that is then directed to the gasifier to heat the gasifier to desired gasification temperatures. Such introduction of the combustion gas for start-up typically introduces undesired impurities or compounds, e.g., water, steam, oxygen, and/or carbon monoxide, which can cause problems within the gasifier and/or downstream components. For example, the water or steam can condense in downstream components such as a particulate control or particulate filter device that does not operate well when water is present.

There is a need, therefore, for improved systems and methods for transitioning a gasifier from an initial or start-up state to a steady or operating state.

BRIEF DESCRIPTION OF THE DRAWINGS

The FIGURE depicts an illustrative gasification system for gasifying one or more hydrocarbon feedstocks, according to one or more embodiments described.

DETAILED DESCRIPTION

Systems and methods for starting a gasifier are provided. In the method, a heated start-up medium can be fed to a gasifier operating at a first temperature. Heat can be transferred from the heated start-up medium to the gasifier to increase the temperature of the gasifier from the first temperature to an intermediate temperature sufficient to auto-ignite a start-up fuel. A start-up fuel and an oxidant can be fed to the gasifier after the temperature within the gasifier is increased to the intermediate temperature. At least a portion of the start-up fuel can be combusted within the gasifier to produce as combustion gas. Heat can be transferred from the combustion gas to the gasifier to increase the temperature of the gasifier to an operating temperature, wherein the operating temperature is sufficient to gasify at least a portion of a hydrocarbon feedstock.

One or more gasifiers can be transitioned from an initial or first state, e.g., an off or non-gasifying state, to a steady or operating state. In the operating state the gasifier can be at a temperature sufficient to at least partially combust and/or gasify one or more hydrocarbon feedstocks fed to the gasifier. The initial or starting state can include one or more first process conditions or parameters such as a first temperature and/or a first pressure. The operating state or steady state can also include one or more process conditions or parameters such as an operating temperature and/or an operating pressure. At least one of the initial process conditions can differ from the corresponding operating state conditions. For example, when the gasifier is in the initial state the first temperature within the gasifier can be less than the operating temperature.

The gasifier can be transitioned from the first state to the operating state using heat provided from one or more heated start-up mediums. The gasifier can be transitioned from the initial state to the steady or operating state using heat provided from a combination of the one or more heated start-up mediums and one or more start-up combustion gases. The one or more start-up combustion gases can be produced within the gasifier. For example, the start-up fuel and one or more oxidants can be directed, fed, or otherwise introduced to the gasifier and at least partially combusted within the gasifier to produce the start-up combustion gas. The heated start-up medium and/or the start-up combustion gas can be circulated through at least a portion of the gasifier. The amount of heated start-up medium and/or start-up combustion gas circulated through the gasifier can be sufficient to increase the temperature within the gasifier from the first temperature to the operating temperature. For example, heat from the heated start-up medium can be transferred to the gasifier to increase the temperature within the gasifier from the first temperature to an intermediate temperature. The intermediate temperature within the gasifier can be sufficient to auto-ignite one or more start-up fuels in the presence of the oxidant to produces the start-up combustion gas. The start-up combustion gas circulated through at least a portion of the gasifier can further increase the temperature within the gasifier to the operating temperature. In another example, heat from the heated start-up medium can be transferred to the gasifier to increase the temperature within the gasifier from the first temperature to the operating temperature.

When starting the gasifier includes directing, feeding, or otherwise introducing the heated start-up medium to the gasifier to increase the temperature within the gasifier to an intermediate temperature followed by directing, feeding, or otherwise introducing the start-up fuel and an oxidant to the gasifier and combusting the start-up filet within the gasifier, a cooled start-up medium, i.e., a start-up medium at a temperature less than the heated start-up medium when fed to the gasifier, can initially be recovered from the gasifier. At least a portion of the cooled start-up medium can be re-heated to produce a re-heated start-up medium. The cooled start-up medium can be reheated outside or external to the gasifier. At least a portion of the re-heated start-up medium can be recycled to the gasifier. As such, all or a portion of the heated start-up medium fed to the gasifier can be recovered from the gasifier as the cooled start-up medium, re-heated, and recycled to the gasifier. The cooled start-up medium recovered from the gasifier can be compressed before re-heating. The cooled start-up medium can be further cooled and/or subjected to a moisture separation or removal process, if desired, prior to compressing and/or re-heating the start-up medium.

The first temperature within the gasifier can be less than a temperature within the gasifier when the gasifier is at the intermediate and/or operating temperatures. For example, the first temperature within the gasifier can be room temperature, e.g., −20° C. to about 50° C. In another example the first temperature within the gasifier can be any temperature less than an auto-ignition temperature of the start-up fuel and/or a hydrocarbon feedstock that can be fed to the gasifier.

The heated start-up medium fed to the gasifier can be at an increased pressure relative to the gasifier when the heated start-up medium is fed thereto. As such, feeding the heated start-up medium to the gasifier can increase the pressure therein. The heated start-up medium can be compressed, e.g., prior to heating via one or more compressors, to produce a compressed start-up medium. The first pressure within the gasifier can range from a low of about 25 kPa, about 50 kPa, about 101 kPa, or about 150 kPa to a high of about 600 kPa, about 1,200 kPa, or about 2,000 kPa. For example, the first pressure within the gasifier can be about 200 kPa to about 800 kPa, about 250 kPa to about 700 kPa, about 300 kPa to about 600 kPa, about 800 kPa to about 2,000 kPa, about 700 kPa to about 1,700 kPa, or about 600 kPa to about 1,500 kPa. The heated start-up medium can increase the pressure within the gasifier from the first pressure to an intermediate pressure ranging from a low of about 50 kPa, about 100 kPa, about 200 kPa, about 400 kPa, or about 600 kPa to a high of about 800 kPa, about 1,000 kPa, about 1,200 kPa, or about 1,400 kPa. For example, the intermediate pressure can range from about 400 kPa to about 1,400 kPa, about 600 kPa to about 1,300 kPa, or about 800 kPa to about 1,250 kPa. In addition to or in lieu of using the heated start-up medium to increase the pressure within the gasifier one or more compressed gases, e.g., compressed nitrogen, syngas, carbon dioxide, or any combination thereof, can be fed to the gasifier in order to increase the pressure therein.

The start-up medium can be a gas, liquid, or combination thereof. For example, the start-up medium can be a gas. Illustrative gases can be or include, but are not limited to, nitrogen, carbon dioxide, combustion gas products, e.g., a recycle combustion gas product, or any combination thereof. Components of the gasifier and/or the gasification system, e.g., systems or devices located downstream from the gasifier, can be sensitive to one or more compounds possibly or potentially contained in the heated start-up medium. For example, components of the gasifier and/or the gasification system can be sensitive to an oxidant, e.g., oxygen, and/or steam content of the heated start-up medium. As such, the heated start-up medium can have a reduced concentration and/or be substantially free from one or more undesired compounds.

The heated start-up medium can have concentration of oxidant, oxygen, of about 5 mol % or less, about 3 mol % or less, about 2 mol % or less, about 1 mol % or less, about 0.5 mol % or less, about 0.1 mol % or less, or about 0.01 mol % or less. In another example, the heated start-up medium can have concentration of oxidant ranging from about 0.1 mol % to about 3 mol %, about 1 mol % to about 3 mol %, about 0.5 mol % to about 2.5 mol %, or about 0.5 mol % to about 2 mol %. The heated start-up medium can have a steam concentration of about 10 mol % or less, about 7 mol % or less, about 5 mol % or less, about 3 mol % or less, about 2 mol % or less, about 1 mol % or less, about 0.5 mol % or less, about 0.1 mol % or less, or about 0.01 mol % or less. En another example, the heated start-up medium can have a steam concentration ranging from about 0.1 mol % to about 10 mol %, about 0.3 mol % to 8 mol %, about 2 mol % to about 9 mol %, about 0.1 mol % to about 3 mol %, about 1 mol % to about 3 mol %, about 0.5 mol % to about 2.5 mol %, or about 0.5 mol % to about 2 mol %. In at least one example, the heated start-up medium can contain less than about 3 mol % oxygen and less than about 20 mol % steam. If the heated start-up medium includes one or more undesirable compounds, e.g., oxygen and/or steam, the start-up medium can be further diluted with one or more inert materials, such as nitrogen, to reduce the concentration of the one or more undesirable compounds to a desired level.

The start-up medium can be or include nitrogen. For example, the start-up medium can have a nitrogen concentration of about 90 mol % or more, about 95 mol % or more, about 97 mol % or more, about 98 mol % or more, about 99 mol % or more, about 99.5 mol % or more, or about 99.9 mol % or more. The start-up medium can be or include carbon dioxide. For example, the start-up medium can have a carbon dioxide concentration of about 90 mol % or more, about 95 mol % or more, about 97 mol % or more, about 98 mol % or more, about 99 mol % or more, about 99.5 mol % or more, or about 99.9 mol % or more. The start-up medium can be or include a combustion product gas. For example, the start-up medium can have a combustion product gas concentration of about 90 mol % or more, about 95 mol % or more, about 97 mol % or more, about 98 mol % or more, about 99 mol % or more, about 99.5 mol % or more, or about 99.9 mol % or more. In another example, the start-up medium can include a combination of two or more of nitrogen, carbon dioxide, and the combustion product gas. The start-up medium containing two or more of the nitrogen, carbon dioxide, and combustion product gas can have a concentration of two or more thereof of about 90 mol % or more, about 95 mol % or more, about 97 mol % or more, about 98 mol % or more, about 99 mol % or more, about 99.5 mol % or more, or about 99.9 mol % or more.

The start-up medium can be heated and re-heated by transferring heat from one or more heat sources to the start-up medium to produce the heated start-up medium. The one or more heat sources can include, but are not limited to, one or more combustion or exhaust gases, steam, one or more exothermic reactions of a reaction mixture, electrical energy converted into heat, mechanical energy converted into heat, or any combination thereof. The steam can be or include low, medium, and/or high pressure steam; low, medium, and/or high pressure superheated steam; or any combination thereof. A make-up start-up medium can be fed to or otherwise combined with the re-heated start-up medium if needed. For example, a portion of the cooled start-up medium can be removed or purged from the gasifier during start-up and the removed start-up medium can be replaced by feeding the make-up start-up medium thereto.

The heat can be transferred via indirect heat exchange with the heat source(s), direct heat exchange with the heat source(s), or a combination of both indirect and direct heat exchange. Preferably the heated start-up medium is produced by indirectly exchanging heat from the heat source(s) to the start-up medium. At least a portion of the heat transferred to the start-up medium to produce the heated start-up medium can be mechanically produced or mechanically derived. For example, the start-up medium can be heated via compression. If two or more heat sources are used, heat can be transferred either directly and/or indirectly to the start-up medium at the same time or at different times. For example, the start-up medium can be first heated via indirect heat exchange with steam and the start-up medium can be further heated via indirect heat exchange with a combustion gas. In another example, the start-up medium can be heated via a combination of compression and indirect heat exchange with a combustion gas. In another example, the start-up medium can be heated via indirect heat exchange with the combustion gas.

The heated start-up medium can be at a temperature ranging from a row of about 100° C., about 50° C., or about 200° C. to a high of about 600° C., about 700° C., about 800° C., or about 900° C. The temperature of the heated start-up medium can be increased from an initial temperature to the intermediate temperature over the course of transitioning the gasifier from the first temperature to the intermediate temperature. For example, the heated start-up medium can initially be at a temperature of about 175° C. to about 250° C. and by the time the gasifier is transitioned to the intermediate temperature the heated start-up medium can be at a temperature of about 500° C. to about 900° C. The heated startup medium can be at a pressure ranging from a low of about 101 kPa, about 200 kPa, or about 400 kPa to a high of about 600 kPa, about 800 kPa, about 1,000 kPa, about 1,500 kPa, or about 2,000 kPa. The pressure of the heated start-up medium can be increased from an initial pressure to an intermediate pressure over the course of transitioning the gasifier from the first temperature to the intermediate temperature. For example, the heated start-up medium can initially be fed to the gasifier at a pressure of about 200 kPa to about 500 kPa and by the time the gasifier is transitioned to the intermediate temperature the heated start-up medium can be at a pressure of about 500 kPa to about 800 kPa.

If the heat source for heating the start-up medium is a combustion gas, one or more fuels ("heater fuels") can be combusted to produce the combustion or exhaust gas. For example, the one or more heater fuels can be combusted in a location external to the gasifier within a burner, furnace, combustor, or other combustion device, system, or any combination of devices and/or systems to produce the combustion gas. At least a portion of the heat from the combustion gas can be transferred, e.g., indirectly and/or by direct mixing, to the start-up medium to produce the heated start-up medium. Preferably heat from the combustion gas is transferred via indirect heat exchange to produce the heated start-up medium. For example, the start-up medium can be passed through a heat exchanger, e.g., one or more coils, disposed within one or more exhaust ducts of one or more combustors, or otherwise placed into thermal communication with the combustion gas.

When the gasifier is heated to the intermediate temperature the one or more start-up fuels and oxidant can be directed, fed, or otherwise introduced to the gasifier. The intermediate temperature can be sufficient to auto-ignite the start-up fuel within the gasifier. Combustion gases produced by combusting at least a portion of the start-up fuel within the gasifier can further increase the temperature within the gasifier from the intermediate temperature to the steady state or operating temperature. The intermediate temperature can be about 200° C. or more, about 300° C. or more, about 400° C. or more, about 500° C. or more, about 550° C. or more, or about 600° C. more. The intermediate temperature can range from about 200° C. to about 700° C., about 200° C. to about 650° C., about 250° C. to about 650° C., about 300° C. to about 600° C. about 350° C. to about 550° C., or about 300° C. to about 600° C. As such, the heated start-up medium can be fed to the gasifier and heat transferred therefrom to increase the temperature of the gasifier to anywhere from about 200° C. to about 600° C. or about 200° C. to about 650° C., for example. The temperature within the gasifier when at the steady or operating state can range from a low of about 700° C., about 800° C., about 900° C., or about 950° C. to a high of about 1,000° C., about 1,100° C., or about 1,200° C. For example, the temperature of the gasifier when at the steady or operating state can range from about 700° C. to about 1,300° C., about 800° C. to about 1,200° C., about 900° C. to about 1,100° C., or about 750° C. to about 1,150° C. As such, a sufficient amount of start-up fuel can be fed to and at least partially combusted within the gasifier to increase the temperature within the gasifier to about 850° C. or more, about 900° C. or more, about 950° C. or more, or about 1,000° C. or more.

The one or more heater fuels and/or the one or more start-up fuels can be a gas, liquid, solid, or any combination thereof. For example, the heater fuel and/or the start-up fuel can include one or more gaseous hydrocarbons, liquid hydrocarbons, solid hydrocarbons, or any combination thereof. Preferably the heater fuel and/or the start-up fuel include one or more hydrocarbons that are gaseous and/or liquid at room temperature and atmospheric pressure. Hydrocarbons suitable for use as the heater fuel and/or the start-up fuel can include, but are not limited to, any hydrocarbon or combination of hydrocarbons having from 1 to about 40 carbon atoms, from 1 to about 30 carbon atoms, or from 1 to about 20 carbon atoms. Suitable hydrocarbons for use as the heater fuel and/or the start-up fuel can include alkanes, cycloalkanes, alkenes, cycloalkenes, alkynes, alkadienes, aromatics, alcohols, or any combination thereof. Suitable mixtures of hydrocarbons that can be used as the heater fuel and/or the start-up fuel include, but are no limited to, natural gas, naphtha, gas oil, fuel oil, diesel, gasoline, kerosene, or any combination thereof. Other suitable materials for use as the heater fuel and/or the start-up fuel can include, but are not limited to, tars, asphaltenes, coal, hydrogen, biomass, or any combination thereof. In at least one example, the heater fuel and/or the start-up fuel can be or include, but is not limited to, coal, wood, asphaltenes, or any combination thereof. In at least one other example, the heater fuel and/or start-up fuel can be or include, but is not limited to, diesel, gasoline, kerosene, naphtha, or any combination thereof.

The start-up fuel can have an auto-ignition temperature of less than about 700° C., less than about 650° C. less than about 600° C., less than about 550° C., less than about 500° C., less than about 450° C., less than about 400° C., less than about 350° C., less than about 300° C., less than about 250° C., or less than about 200° C. For example, the start-up fuel can have an auto-ignition temperature ranging from about 100° C. to about 600° C., about 500° C. to about 600° C., about 250° C.' to about 550° C., about 300° C. to about 600° C., about 350° C. to about 600° C. about 400° C. to about 600° C., about 450° C. to about 600° C., about 305° C. to about 325° C., about 540° C. to about 560° C., or about 245° C. to about 265° C. In another example, the start-up fuel can have an auto-ignition temperature of at least 200° C., at least 250° C., at least 300° C., at least 350° C., at least 375° C., at least 400° C., at least 450° C., at least 500° C. and less than about 700° C., less than about 650° C., or less than about 600° C.

Considering particular heater fuels and/or start-up fuels in more detail, suitable diesel fuels for use as the heater fuel and/or start-up fuel can include hydrocarbons having about 8 carbon atoms to about 25 carbon atoms (C8 to C25 hydrocarbons). The diesel fuel can have an average molecular weight of about 200, a specific gravity of about 0.85, a boiling point ranging from about 180° C. to about 340° C., and an auto-ignition temperature ranging from about 305° C. to about 325° C., e.g., about 315° C. Suitable naphtha fuels for use as the heater fuel and/or start-up fuel can include hydrocarbons having about 5 to about 12 carbon atoms (C5 to C12 hydrocarbons). The naphtha fuel can have a molecular weight ranging from about 100 to about 215, a specific gravity of about 0.7, a boiling point ranging from about 30° C. to about 200° C., and an auto-ignition temperature ranging from about 540° C. to about 560° C., e.g., about 550° C. Suitable gasoline fuels for use as the heater fuel and/or start-up fuel can include hydrocarbons having about 4 to about 12 carbon atoms (C4 to C12 hydrocarbons). The gasoline fuel can have a molecular weight ranging from about 100 to about 105, a specific gravity of about 0.72 to about 0.78, a boiling point ranging from about 26° C. to about 225° C., and an auto-ignition temperature ranging from about 245° C. to about 265° C., e.g., about 257° C.

The heater fuel and/or the start-up fuel can have a low sulfur content which can reduce or minimize sulfur emissions during transitioning the gasifier from the first state to the operating state. For example, the heater fuel and/or the start-up fuel can contain less than about 200 ppm, less than about 150 ppm, less than about 100 ppm, less than about 75 ppm, less than about 50 ppm, or less than about 30 ppm sulfur and/or sulfur containing compounds. In another example, the heater fuel and/or the start-up fuel can contain less than about 40 ppm, less than about 25 ppm, less than about 20 ppm, less than about 15 ppm, less than about 10 ppm, less than about 5 ppm, or less than about 1 ppm sulfur and/or sulfur containing compounds.

The one or more oxidants can be fed with or in conjunction with the startup fuel to the gasifier and at least a portion of the hydrocarbon feedstock can be combusted in the presence of the one or more oxidants to produce the combustion gas and heat. The heat produced by combusting at least a portion of start-up fuel can further increase the temperature within the gasifier to the steady state or operating temperature. The amount of oxidant present within the gasifier for combusting the start-up fuel can be controlled such that an oxidant concentration within the combustion gas, after combusting the start-up fuel, is less than about 3 mol %, less than about 2 mol %, less than about 1 mol %, less than about 0.5 mol %, less than about 0.3 mol %, less than about 0.1 mol %, less than about 0.05 mol %, or less than about 0.01 mol %. For example, the amount of oxidant present in the gasifier after combusting the start-up fuel therein can be zero or can range from a low of about 0.05 mol %, about 0.1 mol %, or about 0.2 mol % to a high of about 0.5 mol %, about 0.7 mol %, about 1 mol %, about 2 mol %, or abut 3 mol %. In another example, the amount of oxidant fed to the gasifier can be about the stoichiometric amount of oxidant required for complete combustion of the start-up fuel or less than the stoichiometric amount of oxidant required for complete combustion of the start-up fuel. As such, in at least one example, a portion of the start-up fuel can remain un-combusted in order to ensure the oxidant fed to the gasifier is consumed in the combustion of the start-up fuel. In one or more embodiments, the oxidant present within the gasifier can be less than about 90 percent, less than about 80 percent, less than about 70 percent, less than about 60 percent, less than about 50 percent, or less than about 40 percent of the stoichiometric amount of oxygen required for complete combustion of all the carbon supplied to the gasifier.

Suitable oxidants for feeding to the gasifier in conjunction with the start-up fuel can include, but are not limited to, air, oxygen, essentially oxygen, oxygen-enriched air, an essentially nitrogen-free oxidant, or any combination thereof. As used herein, the term "essentially oxygen" refers to a fluid containing more than 50 vol % oxygen. As used herein, the term "oxygen-enriched air" refers to a fluid containing about 21 vol % oxygen to about 50 vol % oxygen. Oxygen-enriched air and/or essentially oxygen can be obtained, for example, from cryogenic distillation of air, pressure swing adsorption, membrane separation, or any combination thereof. As used herein, the term "essentially nitrogen-free," refers to an oxidant that contains about 5 vol % nitrogen or less, about 4 vol % nitrogen or less, about 3 vol % nitrogen or less, about 2 vol % nitrogen or less, or about 1 vol % nitrogen or less.

Particulates or solids can also be present within the gasifier. For example, particulates can be circulated through the gasifier. Said another way, operation of the gasifier can include the circulation of particulates therethrough. Circulation of the particulates can be started before and/or during introduction of the heated start-up medium. The particulates can improve heat transfer from the heated start-up medium to the gasifier. The particulates can also improve heat retention within the gasifier. In addition to retaining heat within the gasifier, the particulates can be a carrier or support for the deposition for carbonaceous material that can be produced when introduction of the start-up fuel to the gasifier begins. For example, at least a portion of the start-up fuel or derivatives thereof, e.g., ash, can deposit onto the particulates to produce carbon-containing particulates or "coked" particulates. At least a portion of the coked particulates can be separated from the syngas and recycled or recirculated within the gasifier where at least a portion of the carbon deposited on the particulates can be combusted to produce a portion of the combustion gas and regenerated particulates. As such, the start-up filet can be combusted, vaporized, cracked, gasified, and/or deposited onto solids within the gasifier. At least a portion of the combustion gas can be selectively separated from the hydrocarbon containing solids to provide a gas product.

Once the gasifier transitions from the intermediate state to the steady or operating state, one or more hydrocarbon feedstocks can be directed, fed, or otherwise introduced to the gasifier and at least partially gasified therein to produce gasified hydrocarbons or syngas. In one or more embodiments, at least a portion of the hydrocarbon feedstock can also be combusted within the gasifier to provide a second combustion gas. In one or more embodiments, at least a portion of the hydrocarbon feedstock can also be vaporized in the presence of the third combustion gas to produce vaporized hydrocarbons. In one or more embodiments, at least a portion of the hydrocarbon feedstock can also be cracked in the presence of the gasified hydrocarbons to produce cracked hydrocarbons. In one or more embodiments, at least a portion of the hydrocarbon feedstock can deposit onto the particulates to produce carbon-containing particulates or "coked" particulates. At least a portion of the carbon deposited on the particulates can be combusted within the gasifier to produce a portion of the second combustion gas and regenerated particulates. As such, the hydrocarbon feedstock can be combusted, vaporized, cracked, gasified, and/or deposited onto solids within the gasifier. In one or more embodiments, at least a portion of the second combustion gas, gasified hydrocarbons, vaporized hydrocarbons, and cracked hydrocarbons can be selectively separated from the hydrocarbon containing solids to provide a hot gas product or syngas product.

The syngas product can include, but is not limited to, hydrogen, carbon monoxide, carbon dioxide, methane, nitrogen, steam, hydrogen sulfide, hydrogen chloride, or any combination thereof. In one example, the carbon monoxide content of the syngas product can range from a low of about 10 vol %, about 20 vol %, or about 30 vol % to a high of about 50 vol %, about 70 vol % or about 80 vol %. In another example, the carbon monoxide content of the syngas product can range from a low of about 15 vol %, about 25 vol %, or about 35 vol % to a high of about 65 vol %, about 75 vol % or about 85 vol %. The hydrogen content of the syngas product can range from a low of about 1 about 5 vol %, about 10 vol %, about 15 vol %, or about 20 vol % to a high of about 30 vol %, about 40 vol % or about 50 vol %. In another example, the hydrogen content of the syngas product can range from about 20 vol % to about 30 vol %, about 15 vol % to about 40 vol %, or about 25 vol % to about 50 vol %.

The syngas product can contain less than about 25 vol % or less, about 20 vol % or less, about 15 vol % or less, about 10 vol % or less, or about 5 vol % or less of combined nitrogen, methane, carbon dioxide, steam, hydrogen sulfide, and hydrogen chloride. The carbon dioxide content of the syngas product can be about 25 vol % or less, about 20 vol % or less, about 15 vol % or less, about 10 vol % or less, about 5 vol % or less, about 3 vol % or less, about 2 vol % or less, or about 1 vol % or less. The methane content of the syngas product can be about 15 vol % or less, about 10 vol % or less, about 5 vol % or less, about 3 or less, about 2 vol % or less, or about 1 vol % or less. The steam content of the syngas product can be about 40 vol % or less, about 30 vol % or less, about 25 vol % or less, about 20 vol % or less, about 15 vol % or less, about 10 vol % or less, about 5 vol % or less, about 3 vol % or less, about 2 vol % or less, or about 1 vol % or less. The syngas product can be nitrogen-free or essentially nitrogen-free, e.g., containing about 0.5 vol % or less nitrogen.

The amount of oxidant present within the gasifier for combusting at least a portion of the hydrocarbon feedstock can be controlled such that an oxidant concentration within the gasified hydrocarbons or syngas product is about 3 mol % or less, about 2 mol % or less, about 1 mol % or less, about 0.5 mol % or less, about 0.3 mol % or less, about 0.1 mol % or less, about 0.05 mol % or less, or about 0.01 mol % or less. For example, the amount of oxidant present in the gasifier after combusting and gasifying the hydrocarbon feedstock therein can be zero or can range from a low of about 0.05 mol %, about 0.1 mol %, or about 0.2 mol % to a high of about 0.5 mol %, about 0.7 mol %, or about 1 mol %.

The molar ratio of oxidant to hydrocarbon feedstock within the gasifier can be maintained at a sub-stoichiometric proportion to promote the formation of carbon monoxide over carbon dioxide within the gasifier. The molar ratio of oxidant fed to the gasifier to the total amount of carbonaceous material fed to the gasifier, e.g., the total amount of carbonaceous material in the hydrocarbon feedstock, can be about 0.15:1, about 0.2:1, about 0.24:1, about 0.3:1, or about 0.35:1. The molar ratio of the total oxidant fed to the gasifier to the total amount of carbonaceous material fed to the gasifier can range from about 0.1:1 to about 0.5:1, about 0.15:1 to about 0.45:1, about 0.2:1 to about 0.4:1, or about 0.24:1 to about 0.35:1.

The hydrocarbon feedstock can include any carbon containing material or combination of carbon containing materials, whether gas, liquid, solid, or any combination thereof. For example, the hydrocarbon feedstock can include, but is not limited to, biomass (e.g., plant and/or animal matter and/or plant and/or animal derived matter); coal (e.g., high-sodium and low-sodium lignite, lignite, subbituminous, and/or anthracite, for example); oil shale; coke; tar; asphaltenes; low ash or no ash polymers; hydrocarbon-based polymeric materials; and/or by-products derived from manufacturing operations. The hydrocarbon-based polymeric materials can include, for example, thermoplastics, elastomers, rubbers, including polypropylenes, polyethylenes, polystyrenes, including other polyolefins, homo polymers, copolymers, terpolymers, block copolymers, and blends thereof; PET (polyethylene terephthalate), poly blends, poly-hydrocarbons containing oxygen; heavy hydrocarbon sludge and bottoms products from petroleum refineries and petrochemical plants such as hydrocarbon waxes; blends thereof, derivatives thereof; and combinations thereof.

The hydrocarbon feedstock can include a mixture or combination of two or more carbonaceous materials. For example, the hydrocarbon feedstock can include a mixture or combination of two or more low ash or no ash polymers, biomass derived materials, or by-products derived from manufacturing operations. In another example, the hydrocarbon feedstock can include one or more carbonaceous materials combined with one or more discarded consumer products, such as carpet and/or plastic automotive parts/components including bumpers and dashboards. Such discarded consumer products are preferably suitably reduced in size to fit within the gasifier. In yet another example, the hydrocarbon feedstock can include one or more recycled plastics such as polypropylene, polyethylene, polystyrene, derivatives thereof, blends thereof, or any combination thereof. Accordingly, the process can be useful for accommodating mandates for proper disposal of previously manufactured materials.

The hydrocarbon feedstock, if solid, can have an average particle size ranging from a low of about 1 μm, about 10 μm, about 50 μm, about 100 μm, about 150 or about 200 μm to a high of about 350 μm, about 400 μm, about 450 μm, or about 500 μm. For example, the average particle size of the hydrocarbon feedstock, if solid, can range from about 75 μm to about 475 μm, from about 125 μm to about 425 μm, or about 175 μm to about 375 μm. In another example, the hydrocarbon feedstock, if solid, can be ground to have an average particle size of about 300 μm or less. The hydrocarbon feedstock, if solid, can be fed to the gasifier as a dry feed or can be conveyed to the gasifier as a slurry or suspension. Suitable fluids for forming a slurry or suspension can include, but are not limited to carbon dioxide, steam, water, nitrogen, air, syngas, or any combination thereof.

The initial hydrocarbon feedstock introduction rate to the gasifier can be less than a steady or operating rate. For example, the initial introduction rate of the hydrocarbon feedstock can range from a low of about 1%, about 5%, about 10%, about 15%, or about 2.0% to a high of about 35%, about 40%, about 50%, about 60%, or about 70% of the normal operating rate. As the temperature within the gasifier stabilizes and/or increases the rate of hydrocarbon feedstock introduction can be increased toward a steady or optimal operating rate. For example, the rate of hydrocarbon feedstock introduction can be increased from an initial rate to a steady state or operating rate over a period of time of about 0.5 hours, about 1 hour, about 3 hours, about 5 hours, about 7 hours, about 9 hours or more, about 12 hours or more, about 15 hours or more, about 18 hours or more, about 21 hours or more, or about 24 hours or more. In another example, the initial hydrocarbon feedstock introduction rate to the gasifier can be about or at the normal operating rate.

Once the gasifier has been transitioned from the first temperature to the steady state or operating temperature, introduction of the heated start-up medium to the gasifier can be continued, reduced, and/or stopped. If introduction of the heated start-up medium is stopped and/or reduced, the introduction and/or reduction can be stopped prior to, during, or after introduction of the hydrocarbon feedstock to the gasifier begins. For example, introduction of the hydrocarbon feedstock to the gasifier can be started and gasification, combustion, vaporization, cracking, and/or deposition of the hydrocarbon feedstock onto the particulates can begin prior to stopping the introduction of the start-up medium, in another example, introduction of the start-up medium can increase the temperature within the gasifier a sufficient amount above the auto-ignition and/or gasification temperature of the hydrocarbon feedstock such that introduction of the heated start-up medium can be stopped and the hydrocarbon feedstock can be fed with the temperature within the gasifier remaining sufficient to combust and/or gasify at least a portion of the hydrocarbon feedstock.

Various types of gasifiers can be transitioned from the first or initial state to the hydrocarbon feedstock gasification state using the heated start-up medium. For example, the gasifier can be or include one or more circulating solids or transport gasifiers, one or more fixed bed gasifiers, one or more fluidized bed gasifiers, one or more entrained flow gasifiers, or a combination thereof. The particulates or solids that can be circulated within the gasifier, in addition to or in lieu of serving one or more other purposes, e.g., as a deposition surface for a portion of the hydrocarbon feedstock, the presence of the particulate or solids within the gasifier can improve heat retention within the gasifier and/or heat distribution throughout the gasifier.

The particulates or solids can include, but are not limited to, sand, ceramic materials, ash, crushed limestone, inorganic oxides, or any combination thereof. The limestone can be crushed, pulverized, ground, powdered, or otherwise reduced in particle size. The ash can include any type of ash or mixtures thereof. Illustrative ash can include, but is not limited to, fly ash, gasifier ash, coarse ash, fine ash, or any combination thereof. As used herein, the terms "coarse ash" and "coarse ash particles" are used interchangeably and refer to particulates produced within a gasifier and having an average particle size ranging from a low of about 35 μm, about 45 μm, about 50 μm, about 75 μm or about 100 μm to a high of about 450 μm, about 500 μm, about 550 μm, about 600 μC, or about 640 μm. For example, coarse ash particulates can have an average particle size of from about 50 μm to about 350 μm, about 65 μm to about 250 μm, about 40 μm to about 200 μm, or about 85 μm to about 130 μm. As used herein, the terms "fine ash" and "flue ash particles" are used interchangeably and refer to particulates produced within a gasifier and having an average particle size ranging from a low of about 2 μm, about 5 μm, or about 10 μm to a high of about 75 μm, about 85 μm, or about 95 μm. For example, fine ash particulates can have an average particle size of from about 5 μm to about 30 μm, about 7 μm to about 25 μm, or about 10 μm to about 20 μm. The inorganic oxides can include, but are not limited to, oxides of aluminum, calcium, magnesium, silicon, or any combination thereof.

For a fixed particulate bed, the particulates can be disposed within the gasifier prior to starting the transition of the gasifier from the first state to the hydrocarbon feedstock gasification state. For a circulating solids or transport gasifier, the particulates can be fed to the gasifier before the heat-up or start-up procedure is initiated or started. For example, the particulates can be fed or loaded into the gasifier prior to feeding the heated start-up medium thereto. In another example, additional particulates can be fed while feeding the heated start-up medium to the gasifier. In another example, additional particulates can be fed after the heated start-up medium is fed to the gasifier but before introduction of the hydrocarbon feedstock.

One or more sorbents can also be fed to the gasifier. The sorbents can capture one or more contaminants from the syngas, such as sodium vapor in the gas phase within the gasifier. The sorbents can be used to dust or coat the hydrocarbon feedstock particles prior to or within the gasifier to reduce the tendency for the particles to agglomerate. The sorbents can be ground to an average particle size of about 5 microns to about 100 microns or about 10 microns to about 75 microns. Illustrative sorbents can include, but are not limited to, carbon rich ash, limestone, dolomite, and coke breeze. Residual sulfur released from the second start-up fuel and/or the hydrocarbon feedstock can be captured by native calcium in the second start-up fuel and/or the hydrocarbon feedstock or by a calcium based sorbent to form calcium sulfide.

The FIGURE depicts an illustrative gasification system 100 for gasifying one or more hydrocarbon feedstocks, according to one or more embodiments. The gasification system 100 can include a single gasifier (one is shown 130) or two or more gasifiers arranged in series or parallel (not shown). The gasification system 100 can also include one or more start-up heaters (one is shown 105), one or more heat exchangers "coolers" and/or "heaters" (two are shown 165, 175), one or more particulate control devices (PCDs) (one is shown 170), one or more separators (one is shown 177) and one or more compressors or "recycle compressors" (one is shown 180).

Each gasifier 130 can include one or more mixing or introduction zones (two are shown 135, 140), one or more risers or gasification zones 145, one or more disengagers or separators (two are shown 150 and 155), one or more standpipes 160, and one or more transfer lines (five are shown 147, 151, 153, and 163) if the gasification system 100 includes two or more gasifiers 130, each gasifier 130 can be configured independent from the others or configured where any of the one or more mixing zones 135, 140; risers 145; separators 150, 155; and standpipes 160 can be shared. For simplicity and ease of description, embodiments of the gasification system 100 will be further described in the context of a single reactor train.

Any suitable type of circulating, solids gasifier can be transitioned from the first or initial state to the operating state, e.g., from the first temperature to the operating temperature, using the heated start-up medium fed via line 119 and/or 127. Suitable circulating solids or transport gasifiers can be as discussed and described in U.S. Pat. No. 7,722,690 and U.S. Patent Application Nos. 2008/0081844, 2008/0155899, and 2009/0188165, 2010/0011664, and 2010/0132257.

The start-up heater 105 can be or include any combustion device, system, or combination of devices and/or systems capable of at least partially combusting a start-up fuel. The start-up heater can include a refractory lined chamber that includes one or more burner nozzles where a mixture of the start-up fuel together with an atomizing stream, e.g., steam, can be injected into the chamber and combusted in a stream of pressurized air or other oxidant to produce a flow of hot combustion products. For example, the start-up heater 105 can include one or more combustion zones 111, with or without a refractory lining, one or more exhaust ducts or channels 115, and one or more heat exchangers (two are shown 118, 122). The start-up heater 105 can at least partially combust the one or more start-up fuels fed via line 101 in the presence of the one or more oxidants fed via line 102 within the combustion zone 111 to produce a combustion or exhaust gas. In another example, the start-up heater 105 can be or include a natural draft start-up heater that can at least partially combust the one or more start-up fuels in the presence of aspirated air. The combustion gas can flow through the exhaust duct 115 and can be recovered via line 116 from the exhaust duct 115. Although not shown, in another example, the start-up heater 105 can include a mixing zone for mixing the oxidant and the start-up fuel and a combustion zone for at least partially combusting the start-up fuel/oxidant mixture.

The one or more start-up mediums via line 117 and/or line 121 can be fed to the first heat exchanger 118 and/or the second heat exchanger 122, respectively. The start-up medium fed via lines 117 and/or 121 can flow through the heat exchangers 118, 122, respectively, and a heated start-up medium via lines 119 and 123 can be recovered from heat exchangers 118, 122, respectively. The heated start-up medium via line 119 can be fed to the first mixing zone 135 of the gasifier 130. The heated start-up medium via line 123 can be mixed or otherwise combined with another fluid in line 125 to form a fluid mixture via line 127. Alternatively, the heated start-up medium via line 123 can be fed to the gasifier 130 without mixing or combining with another fluid in line 125. Lines 119 and/or 123 can also be referred to as first transfer lines that can provide fluid communication between the heat exchangers 118, 122, respectively, and the gasifier 130. Heat can be indirectly exchanged from the combustion as to the start-up medium flowing through the first heat exchanger 118 and/or the second heat exchanger 122 to produce the heated start-up medium via lines 119, 123, respectively, and a cooled exhaust gas via line 116. Although the heated start-up medium via lines 119 and/or 127 is illustrated as being fed to the first mixing zone 135, it should be noted that the heated start-up medium via lines 119 and/or 127 can be fed to the first mixing zone 135, the second mixing zone 140, the riser 145, the transfer line 147, 153, 151, and/or 163, the standpipe 160, or any combination thereof.

As shown, the heated start-up medium via lines 119 and/or 127 can be fed to the first mixing zone 135 of the gasifier 130. The heated start-up medium and particulates 137 can exit the riser 145 and can be fed via transfer line 147 to the first separator 150 where at least a portion of the particulates 137 can be separated therefrom to provide a first separated start-up medium via transfer line 151 and separated particulates 137 via transfer line 153. In one or more embodiments, all or a portion of the separated particulates 137 via transfer line 153 can be recycled to the standpipe 160. All or a portion of the separated particulates 137 in transfer line 153 can be removed from the gasifier via line 154. Removing particulates 137 via line 154 from the gasifier 130 can be used to control the height of particulates within the standpipe 160 and/or the total amount of particulates within the gasifier 130. The first separated start-up medium via transfer line 151 can be fed to the second separator 155 where a second portion, if any, of the fluidized particulates 137 can be separated therefrom to produce a separated start-up medium via line 157 and separated particulates 137 that can be fed to the standpipe 160.

The separators 150 and 155 can be or include any device, system, or combination of devises and/or systems capable of separating or removing at least a portion of the particulates from the first combustion gas, the second combustion gas, the gasified hydrocarbons or syngas, or any other fluids, illustrative separators can include, but are not limited to, cyclones, desalters, and/or decanters.

As shown, the separated start-up medium via line 157 can be fed to the one or more heat exchangers 165 to produce a start-up medium via line 167 having a temperature suitable for introduction to the one or more PCDs 170. The heat exchanger 165 can include one or more devices and/or systems suitable for transferring heat from the separated start-up medium in line 157 to produce the start-up medium via line 167 having a temperature suitable for introduction to the one or more PCDs 170. Alternatively, the separated start-up medium in line 157 can bypass the heat exchanger 165 and/or the heat exchanger 165 can be off, i.e., in an inactive or non-promoting heat exchange condition. The heat exchanger 165 can include, but is not limited to, single or multiple pass heat exchange devices such as shell and tube heat exchangers, plate and frame heat exchangers, spiral heat exchangers, bayonet type heat exchangers, U-tube heat exchangers, and/or any similar systems and/or devices. Other suitable heat exchangers 165 can include vessels or other containers having an internal volume or zone for combining the cooled start-up medium with a heated medium, contact or mixing. Preferably, the temperature of the start-up medium in line 167 can be maintained at a sufficient temperature to prevent and/or reduce condensation of any steam that may be present in the start-up medium. The temperature of the start-up medium in line 167 can also be maintained at a sufficient temperature to prevent and/or reduce the possibility or likelihood of oxidation of the PCD 170 should oxygen be present in the start-up medium.

The start-up medium via line 167 can be fed to the one or more particulate control devices (PCDs) 170 which can remove at least a portion of any remaining particulates or fines contained therein via line 171 to produce a recovered start-up medium via line 172. The recovered start-up medium via line 172 can be removed from the gasification system 100 via line 173, recycled via line 174 within the gasification system 100, or a combination thereof.

The particulate control device 170 can include one or more separation devices, for example, conventional disengagers and/or cyclones. Particulate control devices capable of providing an outlet particulate concentration below about 10 parts per million by weight (ppmw) or about 1 ppmw or about 0.1 ppmw can be used. Examples of suitable particulate control devices can include, but are not limited to, sintered metal filters, metal filter candles, and/or ceramic filter candles (for example, iron aluminide filter material).

As illustrated, the recovered start-up medium via line 174 can be fed to the one or more heat exchangers 175 to provide a cooled start-up medium via line 176. The one or more heat exchangers 171 can be similar to heat exchanger 165 discussed and described above. The heat exchanger 171 can cool the start-up medium to a temperature sufficient to condense at least a portion of any water contained therein. As such, should the start-up medium contain any steam or water vapor, at least a portion of the steam and/or vapor can be condensed.

The cooled start-up medium via line 176 can be fed to the one or more separators 177 where at least a portion of the condensed water, if any can be separated and recovered via line 178. The separator 177 can be a column containing trays, rings, balls, or saddles in any frequency and/or combination. The separator 177 can be a partially or completely empty column. The separator 177 can include one or more adsorbents and/or absorbent materials capable of removing water from the cooled start-up medium.

A dried start-up medium via line 179 containing less water vapor than the start-up medium in line 176 can be recovered from the separator 177 and fed to the recycle compressor 180 to produce a compressed start-up medium via line 182. The dried start-up medium in line 179 can contain about 20 wt % or less, about 17 wt % or less, about 14 wt % or less, about 12 wt % or less, about 10 wt % or less, about 7 wt % or less, about 5 wt % or less, about 3 wt % or less, about 2 wt % or less, about 1 wt % or less, or about 0.5 wt % or less water. The compressed start-up medium via line 182 can be fed via line 185 to line 117 and/or 121 to the first and/or second heat exchangers 118, 119, respectively, as discussed and described above. Lines 182, 185, 117, and/or 121 can also be referred to as second transfer lines that can provide fluid communication between the recycle compressor 180 and heat exchangers 118, 122. A make-up or additional start-up medium via line 183 can be mixed with the compressed start-up medium in line 182. The make-up or additional start-up medium fed via line 183 can be used to replace and/or increase the amount of start-up medium fed and circulated through the gasification system 100. Although not shown, at least a portion of the start-up medium via line 182 can be fed to the gasifier 130 via lines 152, 159, and/or 162 to provide at least a portion of the motive fluid for circulating the particulates 137 therein.

The one or more recycle compressors 180 can include any type of compressor or combination of compressors. The recycle compressor 180 can be or include, but is not limited to, centrifugal compressors, axial compressors, rotary positive displacement compressors, diagonal or mixed-flow compressors, reciprocating compressors, dry screw compressors, oil flooded screw compressors, scroll compressors, and the like. The recycle compressor 180 can include one or more compression stages. For example, the recycle compressor 180 can be a two stage or a three stage compressor. If the recycle compressor 180 includes two or more compressors the two or more compressors can be the same type of compressor or different.

The particulates 137 within the standpipe 160 can be recycled to the riser 145 via transfer or recycle line 163. The recycled particulates can be fed to the first mixing zone 135, the second mixing zone 140, or, as shown, between the first and second mixing zones 135, 140. As discussed and described above, the particulates 137 can be loaded or otherwise disposed within the gasifier 130 prior to feeding the heated start-up medium via lines 119 and/or 127 to the gasifier 130. As such, circulation of the particulates 137 can begin prior to feeding the heated startup medium via lines 119 and/or 127 to the first mixing zone 135. In another example, additional or make-up particulates 137 can begin during introduction of the heated start-up medium via lines 119 and/or 127.

One or more circulation or fluidizing fluids via one or more fluid introduction lines (three are shown 152, 159, and 162) can be fed to the transfer line 153, standpipe 160, and recycle line 163, respectively, in order to provide a motive fluid within the gasifier 130 for circulating the particulates 137 within the gasifier 130. Illustrative fluids fed via lines 152, 159, 162 can include, but are not limited to, inert gases such as nitrogen, combustible gases such as recycled syngas, carbon dioxide, combustion gas products, recycled gas from the compressor 180, or any combination thereof.

The heated start-up medium fed via lines 119 and/or 127 to the gasifier 130 can increase the temperature within the gasifier 130, and, if present, the temperature of the particulates 137 circulating therein, from the initial temperature to the intermediate temperature. Once the gasifier 130 transitions from the initial temperature to the intermediate temperature the start-up fuel via line 128 can be fed to the gasifier 130. At least a portion of the start-up fuel fed via line 128 can autoignite and combust within the gasifier to produce a combustion gas. The combustion gas can produce heat which can further increase the temperature of the gasifier to the steady state or operating temperature. The start-up fuel via line 128 can be fed to the first mixing zone 135, the second mixing zone 140, and/or the riser 145. The oxidant via line 125 can be fed along with the start-up fuel via line 128. If desired, the oxidant can be mixed or otherwise combined with at least a portion of the start-up medium to provide an oxidant/start-up medium mixture via line 127. The start-up fuel can be combusted in the presence of the oxidant to produce the combustion gas. Alternatively, or in addition to the oxidant via line 125 and/or 127, the start-up fuel can be mixed or otherwise combined with one or more oxidants. The start-up fuel via line 128 and the oxidant via line 125 and/or 127 can be as discussed and described above.

Once the gasifier 130 transitions from the intermediate temperature to the steady state or operating temperature the hydrocarbon feedstock via line 129 can be fed to the gasifier 130. The hydrocarbon feedstock via line 129 can be fed to the first mixing zone 135, the second mixing zone 140, and/or the riser 145. For example, the hydrocarbon feedstock via line 129 can be fed to the second mixing zone 140. The oxidant via line 125 and/or 127 can also be fed to the gasifier 130 and at least a portion of the hydrocarbon feedstock fed via line 129 can be combusted in the presence of the oxidant, thereby producing another combustion gas and heat. The amount of oxidant within the gasifier 130 available for combusting a portion of the hydrocarbon feedstock fed via line 129 can be controlled by adjusting the amount of the one or more oxidants fed via line 125 and/or 127 to the gasifier 130.

In addition to combusting a portion of the hydrocarbon feedstock within the gasifier, at least a portion of the hydrocarbon feedstock can be gasified, vaporized, cracked, and/or deposited onto the circulating particulates 137 to produce the combustion gas, vaporized hydrocarbons, cracked hydrocarbons, and/or carbon containing particulates. The hot gas product or syngas can be separated from the particulates (if present) via the first and second separators 150, 155 and recovered as a hot gas product or syngas via line 157.

As discussed and described above, all or a portion of the heated start-up medium via line 123 can be mixed or combined with one or more fluids, e.g., oxidant(s), in line 125 and fed via line 127 to the gasifier 130. As such, should the concentration of oxidant in line 125 be too high, the oxidant content thereof can be diluted to a desired concentration using the heated start-up medium that can be mixed therewith via line 123 to form a mixed oxidant via line 127. Combining the oxidant in line 125 with at least a portion of the heated start-up medium in line 123 can also increase the temperature of the oxidant ultimately fed via line 127 to the gasifier 130. Combining the oxidant in line 125 with the heated start-up medium can also pre-heat the oxidant prior to introduction to the gasifier 130.

The cooled syngas via line 167 can be fed to the one or more particulate control devices 170. As discussed and described above, the particulate control device 170 can remove at least a portion of any remaining particulates or fines via line 171 to produce a syngas product via line 172. The syngas product in line 172 can be recovered from the gasification system 100 via line 173. The syngas product in line 174 can be recycled via line 174 within the gasification system. A portion of the syngas product via line 172 can be recovered from the gasification system 100 and a portion of the syngas product via line 174 can be recycled within the gasification system 100. Once the gasifier 130 reaches the steady state or operating temperature the introduction of the start-up fuel via line 128 and/or the start-up medium via line 119 and/or 127 to the gasifier 130 can be stopped, if continued when the hydrocarbon feedstock via line 129 initially begins. As such, recycle of the syngas product via line 174 and via the start-up heater 105 can be stopped, not initiated to begin with, and/or decreased and/or stopped over a period of time.

Introduction of the heated start-up medium via lines 119 and/or 127 and/or the start-up fuel via line 128 can be stopped before, when, or after introduction of the hydrocarbon feedstock via line 129 begins. Introduction of the heated start-up medium via lines 119 and/or 127 and/or the start-up fuel via line 128 can be stopped over a short period of time, e.g., less than about a minute, or gradually over an extended period of time, e.g., minutes, tens of minutes, or even hours. As such, stopping introduction of the heated start-up medium via lines 119 and/or 127 can occur over a short period of time or can gradually transition from a full introduction rate to none.

The syngas product via line 173 can be further processed according to any desired manner. For example, at least a portion of the syngas product in line 173 can be directed to a gas or combustion turbine which can be coupled to a generator to produce electrical power. In another example, at least a portion of the syngas in line 173 can be separated to produce a hydrogen product. In another example, at least a portion of the syngas can be directed to one or more gas converters to produce one or more Fischer-Tropsch products, methanol, ammonia, chemicals, hydroformylation products, and/or feedstocks, derivatives thereof, and/or combinations thereof.

The one or more Fischer-Tropsch products can include, but are not limited to, one or more hydrocarbons having a wide range of molecular weights, spanning from light gaseous hydrocarbons ($C_1$-$C_4$), naphtha ($C_5$-$C_{10}$), diesel ($C_{11}$-$C_{20}$), and wax (>$C_{20}$), derivatives thereof, or combinations thereof. Illustrative Fischer-Tropsch products can include, but are not limited to, diesel fuels, kerosene, aviation fuels, propane, butane, LPG, lubricants, naphtha, gasoline, detergents, waxes, lubricants, refinery/petrochemical feedstocks, other transportation fuels, synthetic crude oil, liquid fuels, alpha olefins, or any combination thereof.

The methanol can be used as produced and/or further processed to provide one or more additional products. Additional products produced from methanol can include, but are not limited to, dimethyl ether ("DME"), formalin, acetic acid, formaldehyde, methyl-tertiary butyl ether, methylamines, methyl methacrylate, dimethyl terephthalate, methyl mercaptan, methyl chloride methyl acetate, acetic anhydride, ethylene, propylene, polyolefins, derivatives thereof, mixtures thereof, or combinations thereof.

The ammonia product can be used as produced and/or further processed to provide one or more additional products. Additional products that can be produced, at least in part, from ammonia can include, but are not limited to, urea, ammonium salts, ammonium phosphates, nitric acid, acrylonitrile, amides, and the like.

Illustrative systems and methods for further processing at least a portion of the syngas product in line 173 can be as discussed and described in U.S. Pat. Nos. 7,932,296; 7,722,690; 7,687,041; and 7,138,001 and U.S. Patent Application Publication Nos. 2009/0294328; 2009/0261017; 2009/0151250; and 2009/0064582.

In order to provide a better understanding of the foregoing discussion, the following non-limiting examples are offered. Although the examples may be directed to specific embodiments, they are not to be viewed as limiting the invention in any specific respect. All parts, proportions, and percentages are by weight unless otherwise indicated.

Prophetic Example

Embodiments can be further described with the following prophetic example. Although the simulated example is directed to a specific embodiment, it is not to be viewed as limiting the invention in any specific respect.

The following simulated results shown in the Table below illustrate a gasification start-up process according to one or more embodiments discussed and described above with reference to the FIGURE. The simulated gasifier start-up process shows simulated process/gasifier conditions occurring every hour over a period of 35 hours. The total nitrogen usage is the combined heated start-up medium fed via line 129 and the fluidization medium fed via lines 152, 159, and 162 to the gasifier 130. The additional nitrogen or fluidization medium (total $N_2$ minus amount heated start-up medium) fed to the gasifier 130 is fed via lines 152, 159, and 162 to provide a motive fluid for circulating the particulates 137 through the gasifier 130. The gasifier 130 is at a starting temperature of 20° C. and a starting pressure of 445 kPa.

TABLE

Gasifier Start-up

| Time | Amount Heated Start-up Medium ($N_2$), kg/hr | Total $N_2$ usage, kg/hr | Feedstock Flow, kg/hr | Air, kg/hr | Heater Duty, MMkcal/hr | Combined Start-up Medium and Fluidization Medium Temp. In, ° C. | Combined Start-up Medium and Fluidization Medium Temp. Out, ° C. | Gasifier Temp., ° C. | Gasifier Press., kPa | $O_2$ content at PCD, mol % wet | Exhaust Gas Outlet Temp., ° C. |
|---|---|---|---|---|---|---|---|---|---|---|---|
| 0 | 0 | 0 | 0 | 0 | 0.00 | 0 | 0 | 20 | 445 | 0 | 214 |
| 1 | 48,000 | 60,374 | 0 | 0 | 1.41 | 190 | 92 | 42 | 445 | 0 | 214 |
| 2 | 47,000 | 59,374 | 0 | 0 | 1.70 | 211 | 115 | 64 | 445 | 0 | 241 |
| 3 | 45,000 | 57,374 | 0 | 0 | 1.98 | 234 | 137 | 85 | 445 | 0 | 271 |
| 4 | 43,000 | 55,374 | 0 | 0 | 2.21 | 255 | 156 | 105 | 445 | 0 | 300 |
| 5 | 43,000 | 55,374 | 0 | 0 | 2.49 | 275 | 177 | 126 | 530 | 0 | 325 |
| 6 | 43,000 | 55,636 | 0 | 0 | 2.80 | 296 | 198 | 147 | 530 | 0 | 353 |
| 7 | 43,000 | 55,636 | 0 | 0 | 3.10 | 317 | 219 | 167 | 530 | 0 | 380 |
| 8 | 43,000 | 55,784 | 0 | 0 | 3.40 | 337 | 240 | 188 | 578 | 0 | 407 |
| 9 | 43,000 | 55,784 | 0 | 0 | 3.70 | 358 | 261 | 209 | 578 | 0 | 433 |
| 10 | 43,000 | 55,784 | 0 | 0 | 4.00 | 379 | 282 | 230 | 578 | 0 | 460 |
| 11 | 43,000 | 55,784 | 0 | 0 | 4.31 | 400 | 303 | 251 | 578 | 0 | 487 |
| 12 | 43,000 | 55,993 | 0 | 0 | 4.63 | 421 | 323 | 272 | 646 | 0 | 515 |
| 13 | 43,000 | 55,993 | 0 | 0 | 4.94 | 442 | 345 | 293 | 646 | 0 | 542 |
| 14 | 43,000 | 55,993 | 0 | 0 | 5.25 | 463 | 365 | 315 | 646 | 0 | 569 |
| 15 | 43,000 | 56,202 | 0 | 0 | 5.60 | 485 | 387 | 336 | 714 | 0 | 599 |
| 16 | 43,000 | 56,202 | 0 | 0 | 5.91 | 506 | 409 | 358 | 714 | 0 | 626 |
| 17 | 43,000 | 56,202 | 0 | 0 | 6.25 | 528 | 431 | 379 | 714 | 0 | 654 |
| 18 | 43,000 | 56,202 | 0 | 0 | 6.56 | 549 | 452 | 401 | 714 | 0 | 680 |
| 19 | 43,000 | 56,411 | 0 | 0 | 6.92 | 571 | 474 | 423 | 782 | 0 | 730 |
| 20 | 43,000 | 56,411 | 0 | 0 | 7.26 | 593 | 496 | 445 | 782 | 0 | 739 |
| 21 | 43,000 | 56,620 | 0 | 0 | 7.63 | 615 | 518 | 467 | 850 | 0 | 769 |
| 22 | 43,000 | 56,620 | 0 | 0 | 7.97 | 637 | 541 | 489 | 850 | 0 | 797 |
| 23 | 43,000 | 56,620 | 0 | 0 | 8.31 | 659 | 562 | 511 | 850 | 0 | 825 |
| 24 | 25,000 | 56,114 | 1,786.73 | 17,867 | 0.00 | 705 | 593 | 544 | 986 | 1.38 | n/a |
| 25 | 25,000 | 57,929 | 1,990.79 | 19,908 | 0.00 | 740 | 629 | 578 | 1,071 | 1.47 | n/a |
| 26 | 25,000 | 60,211 | 2,236.98 | 22,370 | 0.00 | 777 | 665 | 614 | 1,207 | 1.57 | n/a |
| 27 | 20,000 | 54,744 | 2,175.36 | 21,754 | 0.00 | 810 | 699 | 647 | 1,207 | 1.65 | n/a |

TABLE-continued

| Gasifier Start-up | | | | | | | | | | | |
|---|---|---|---|---|---|---|---|---|---|---|---|
| Time | Amount Heated Start-up Medium ($N_2$), kg/hr | Total $N_2$ usage, kg/hr | Feedstock Flow, kg/hr | Air, kg/hr | Heater Duty, MMkcal/hr | Combined Start-up Medium and Fluidization Medium Temp. In, ° C. | Combined Start-up Medium and Fluidization Medium Temp. Out, ° C. | Gasifier Temp., ° C. | Gasifier Press., kPa | $O_2$ content at PCD, mol % wet | Exhaust Gas Outlet Temp., ° C. |
| 28 | 20,000 | 56,494 | 2,406.34 | 24,063 | 0.00 | 845 | 734 | 681 | 1,207 | 1.75 | n/a |
| 29 | 20,000 | 59,125 | 2,684.91 | 26,849 | 0.00 | 878 | 468 | 718 | 1,377 | 1.84 | n/a |
| 30 | 20,000 | 61,927 | 3,027.36 | 30,274 | 0.00 | 917 | 808 | 756 | 1,445 | 1.94 | n/a |
| 31 | 15,000 | 56,378 | 2,956.31 | 29,563 | 0.00 | 955 | 846 | 792 | 1,445 | 2.05 | n/a |
| 32 | 10,000 | 50,579 | 2,827.23 | 28,272 | 0.00 | 990 | 880 | 826 | 1,500 | 2.15 | n/a |
| 33 | 10,000 | 53,475 | 3,209.48 | 32,095 | 0.00 | 1,030 | 920 | 862 | 1,500 | 2.26 | n/a |
| 34 | 5,000 | 46,547 | 2,920.83 | 29,208 | 0.00 | 1,055 | 945 | 893 | 1,585 | 2.33 | n/a |
| 35 | 5,000 | 48,917 | 3,233.66 | 32,337 | 0.00 | 1,085 | 983 | 930 | 1,585 | 2.42 | n/a |

As shown in the Table the gasifier 130 is transitioned from the first temperature (20° C.) at a time equals 0 hours to the intermediate temperature (511° C.) at time equals 24 hours by feeding the heated start-up medium via line 119 to the gasifier 130. As shown in the Table, the "temperature" of the gasifier refers to the temperature of a refractory lining of the gasifier 130 during start-up. At hour 24 introduction of the hydrocarbon feedstock via line 129 and the oxidant (air) via line 125 to the gasifier 130 is started. For this particular simulated example, the heated start-up medium via line 119 is used to transfer the gasifier 130 from the first or initial temperature to 511° C. Then the feedstock via line 129 is fed to the gasifier 130 and initially combusted to bring the gasifier up to the gasification temperature. As such, the feedstock is combusted to transition the gasifier 130 from about 511° C. to about 900° C.

The hydrocarbon feedstock via line 129 is initially fed at a rate of 1,787 kg/hr and the rate of hydrocarbon feedstock introduction is increased to 3,233.66 by the time equals to 35 hours. The heater or burner 105 duty increases from 1.41 MMkcal/hr (time equals 1 hour) up to 8.31 MMkcal/hr at time equals 23 hours, respectively. The oxygen concentration in the gas exiting the gasifier remains at 0 mol % wet during the entire transition from the first temperature to the operating temperature. The oxygen concentration only appears when introduction of the hydrocarbon feedstock and an oxidant is started. As such, the gasifier start-up process shown in this simulated example transitioned the gasifier 130 from the first temperature (20° C.) to the intermediate temperature (511° C.), which is sufficient to combust a portion of the hydrocarbon feedstock without generating any oxygen in the start-up gas recovered via line 157 from the gasifier 130. Additionally, the total amount of nitrogen used during start-up of the gasifier 130 was maintained at less than 62,000 kg/hr.

Embodiments discussed and described herein further relate to any one or more of the following paragraphs:

1. A method for starting a gasifier, comprising: feeding a heated start-up medium to a gasifier operating at a first temperature; transferring heat from the heated start-up medium to the gasifier to increase the temperature of the gasifier from the first temperature to an intermediate temperature sufficient to auto-ignite a start-up fuel; feeding a start-up fuel and an oxidant to the gasifier after the temperature within the gasifier is increased to the intermediate temperature; combusting at least a portion of the start-up fuel within the gasifier to produce a combustion gas; and transferring heat from the combustion gas to the gasifier to increase the temperature of the gasifier to an operating temperature, wherein the operating temperature is sufficient to gasifi at least a portion of a hydrocarbon feedstock.

2. The method according to paragraph 1, further comprising: recovering a cooled start-up medium from the gasifier; re-heating at least a portion of the cooled start-up medium to produce the heated start-up medium; and recycling the heated startup medium to the gasifier.

3. The method according to paragraph 2, wherein re-heating the cooled start-up medium comprises: combusting a start-up fuel to produce a combustion gas; and indirectly transferring heat from the combustion gas to the cooled start-up medium to produce the heated start-up medium.

4. The method according to any one of paragraphs 1 to 3, further comprising: feeding a hydrocarbon feedstock to the gasifier after the gasifier is heated to the operating temperature; and gasifying at least a portion of the hydrocarbon feedstock to produce a syngas product.

5. The method according to paragraph 4, wherein the syngas product comprises hydrogen and carbon monoxide, wherein the syngas product has a hydrogen concentration ranging from about 10 vol % to about 40 vol % and a carbon monoxide concentration ranging from about 20 vol % to about 70 vol %.

6. The method according to any one of paragraphs 1 to 5, further comprising: feeding a hydrocarbon feedstock to the gasifier after the gasifier is heated to the operating temperature; combusting a portion of the hydrocarbon feedstock to produce another combustion gas; gasifying a portion of the hydrocarbon feedstock to produce a syngas product; and stopping introduction of the start-up fuel once feeding the hydrocarbon feedstock has started.

7. The method according to any one of paragraphs 1 to 6, further comprising circulating particulates through the gasifier.

8. The method according to paragraph 7, wherein the particulates comprise sand, ceramic materials, ash, crushed limestone, inorganic oxides, or any combination thereof.

9. The method according to any one of paragraphs 1 to 8, wherein the intermediate temperature ranges from about 200° C. to about 650° C., and wherein the operating temperature ranges from about 800° C. to about 1200° C.

10. The method according to any one of paragraphs 1 to 9, wherein the heated start-up medium comprises nitrogen, carbon dioxide, a combustion product gas, or any combination thereof.

11. The method according to any one of paragraphs 1 to 10, wherein the heated start-up medium contains less than about 3 mol % oxygen and less than about 20 mol % steam.

12. A method for starting a gasifier, comprising: circulating particulates through a gasifier operating at a first temperature; increasing the first temperature to an operating temperature, wherein increasing the first temperature to the operating temperature comprises: directing a heated start-up medium to the gasifier; flowing the heated start-up medium through the gasifier to transfer heat from the heated start-up medium to the gasifier; recovering a cooled start-up medium from the gasifier; re-heating the cooled start-up medium outside the gasifier; recycling the re-heated start-up medium to the gasifier; directing a start-up fuel and an oxidant to the gasifier when the gasifier is at an intermediate temperature, wherein the intermediate temperature is sufficient to auto-ignite the start-up fuel within the gasifier; combusting at least a portion of the start-up fuel within the gasifier to produce a combustion gas; and transferring heat from the combustion gas to the gasifier to increase the temperature of the gasifier to the operating temperature; directing a hydrocarbon feedstock to the gasifier when the temperature within the gasifier reaches the operating temperature; gasifying at least a portion of the hydrocarbon feedstock within the gasifier to produce a syngas; and recovering the syngas from the gasifier.

13. The method according to paragraph 12, wherein re-heating the cooled start-up medium comprises: combusting a heater fuel to produce a combustion gas; and indirectly transferring heat from the combustion gas to the cooled start-up medium to produce the heated start-up medium.

14. The method according to paragraph 12 or 13, further comprising compressing the cooled start-up medium prior to re-heating the start-up medium.

15. The method according to any one of paragraphs 12 to 14, wherein the heated start-up medium contains less than about 3 mol % oxygen and less than about 20 mol % steam.

16. The method according to any one of paragraphs 12 to 15, wherein the intermediate temperature ranges from about 500° C. to about 650° C., and wherein the operating temperature ranges from about 850° C. to about 1,200° C.

17. The method according to any one of paragraphs 12 to 16, wherein the particulates comprise sand, ceramic materials, ash, crushed limestone, inorganic oxides, or any combination thereof.

18. The method according to any one of paragraphs 12 to 17, further comprising increasing a pressure within the gasifier from a first pressure to an operating pressure as the temperature within the gasifier is increased from the first temperature to the operating temperature.

19. The method according to any one of paragraphs 12 to 18, wherein the heated start-up medium comprises nitrogen, carbon dioxide, a combustion gas, or any combination thereof.

20. A method for starting a gasifier, comprising: circulating particulates through a gasifier operating at a first temperature; increasing the first temperature to an operating temperature, wherein increasing the first temperature to the operating temperature comprises: directing a heated start-up medium to the gasifier, wherein the heated start-up medium comprises nitrogen and contains less than about 3 mol % oxygen and less than about 20 mol % steam; flowing the heated start-up medium through the gasifier to transfer heat from the heated start-up medium to the gasifier; recovering a cooled start-up medium from the gasifier; re-heating the cooled start-up medium outside the gasifier; recycling the re-heated start-up medium to the gasifier; directing a start-up fuel and an oxidant to the gasifier when the gasifier is at an intermediate temperature, wherein the intermediate temperature is sufficient to auto-ignite the start-up fuel within the gasifier, and wherein the start-up fuel comprises one or more hydrocarbons that are liquid at room temperature and pressure; combusting at least a portion of the start-up fuel within the gasifier to produce a combustion gas; and transferring heat from the combustion gas to the gasifier to increase the temperature of the gasifier to the operating temperature; directing a hydrocarbon feedstock to the gasifier when the temperature within the gasifier reaches the operating temperature; combusting a portion of the hydrocarbon feedstock to produce a second combustion gas; and gasifying a portion of the hydrocarbon feedstock to produce a syngas.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method for starting a gasifier, comprising:

feeding a heated start-up medium to a gasifier operating at a first temperature;

transferring heat from the heated start-up medium to the gasifier to increase the temperature of the gasifier from the first temperature to an intermediate temperature sufficient to auto-ignite a start-up fuel;

feeding a start-up fuel and an oxidant to the gasifier after the temperature within the gasifier is increased to the intermediate temperature:

combusting at least a portion of the start-up fuel within the gasifier to produce a combustion gas;

transferring heat from the combustion gas to the gasifier to increase the temperature of the gasifier to an operating temperature, wherein the operating temperature is sufficient to gasify at least a portion of a hydrocarbon feedstock;

recovering a cooled start-up medium from the gasifier;

re-heating at least a portion of the cooled start-up medium to produce the heated start-up medium; and recycling the heated start-up medium to the gasifier.

2. The method of claim 1, wherein the heated start-up medium comprises about 90 mol % or more of nitrogen, carbon dioxide, a combustion product gas, or any mixture thereof, and wherein the heated start-up medium contains oxygen in an amount of about 3 mol % or less and steam in an amount of about 10 mol % or less.

3. The method of claim 1, wherein re-heating the cooled start-up medium comprises:

combusting a start-up fuel to produce a combustion gas; and indirectly transferring heat from the combustion gas to the cooled start-up medium to produce the heated start-up medium.

4. The method of claim 1, further comprising:

feeding a hydrocarbon feedstock to the gasifier after the gasifier is heated to the operating temperature; and gasifying at least a portion of the hydrocarbon feedstock to produce a syngas product.

5. The method of claim 4, wherein the syngas product comprises hydrogen and carbon monoxide, wherein the syngas product has a hydrogen concentration ranging from about 10 vol % to about 40 vol % and a carbon monoxide concentration ranging from about 20 vol % to about 70 vol %.

6. The method of claim 1, further comprising:

feeding a hydrocarbon feedstock to the gasifier after the gasifier is heated to the operating temperature;

combusting a portion of the hydrocarbon feedstock to produce another combustion gas;

gasifying a portion of the hydrocarbon feedstock to produce a syngas product; and stopping introduction of the start-up fuel once feeding the hydrocarbon feedstock has started.

7. The method of claim 1, further comprising circulating particulates through the gasifier.

8. The method of claim 7, wherein the particulates comprise sand, ceramic materials, ash, crushed limestone, inorganic oxides, or any combination thereof.

9. The method of claim 1, wherein the intermediate temperature ranges from about 200° C. to about 650'C, and wherein the operating temperature ranges from about 800° C. to about 1,200° C.

10. The method of claim 1, wherein the heated start-up medium comprises nitrogen, carbon dioxide, a combustion product gas, or any combination thereof.

11. The method of claim 10, wherein the heated start-up medium contains less than about 3 mol % oxygen and less than about 20 mol % steam.

12. A method for starting a gasifier, comprising:

circulating particulates through a gasifier operating at a first temperature;

increasing the first temperature to an operating temperature, wherein increasing the first temperature to the operating temperature comprises:

directing a heated start-up medium to the gasifier;

flowing the heated start-up medium through the gasifier to transfer heat from the heated start-up medium to the gasifier;

recovering a cooled start-up medium from the gasifier;

re-heating the cooled start-up medium outside the gasifier;

recycling the re-heated start-up medium to the gasifier;

directing a start-up fuel and an oxidant to the gasifier when the gasifier is at an intermediate temperature, wherein the intermediate temperature is sufficient to auto-ignite the start-up fuel within the gasifier;

combusting at least a portion of the start-up fuel within the gasifier to produce a combustion gas; and transferring heat from the combustion gas to the gasifier to increase the temperature of the gasifier to the operating temperature;

directing a hydrocarbon feedstock to the gasifier when the temperature within the gasifier reaches the operating temperature;

gasifying at least a portion of the hydrocarbon feedstock within the gasifier to produce a syngas; and recovering the syngas from the gasifier.

13. The method of claim 12, wherein re-heating the cooled start-up medium comprises:

combusting a heater fuel to produce a combustion gas; and indirectly transferring heat from the combustion gas to the cooled start-up medium to produce the heated start-up medium.

14. The method of claim 13, further comprising compressing the cooled start-up medium prior to re-heating the start-up medium.

15. The method of claim 12, wherein the heated start-up medium contains less than about 3 mol % oxygen and less than about 20 mol % steam.

16. The method of claim 12, wherein the intermediate temperature ranges from about 500° C. to about 650° C., and wherein the operating temperature ranges from about 850° C. to about 1,200° C.

17. The method of claim 12, wherein the particulates comprise sand, ceramic materials, ash, crushed limestone, inorganic oxides, or any combination thereof.

18. The method of claim 12, further comprising increasing a pressure within the gasifier from a first pressure to an operating pressure as the temperature within the gasifier is increased from the first temperature to the operating temperature.

19. The method of claim 12, wherein the heated start-up medium comprises nitrogen, carbon dioxide, a combustion gas, or any combination thereof.

20. A method for starting a gasifier, comprising:

circulating particulates through a gasifier operating at a first temperature;

increasing the first temperature to an operating temperature, wherein increasing the first temperature to the operating temperature comprises:

directing a heated start-up medium to the gasifier, wherein the heated start-up medium comprises nitrogen and contains less than about 3 mol % oxygen and less than about 20 mol % steam;

flowing the heated start-up medium through the gasifier to transfer heat from the heated start-up medium to the gasifier;

recovering a cooled start-up medium from the gasifier;

re-heating the cooled start-up medium outside the gasifier;

recycling the re-heated start-up medium to the gasifier;

directing a start-up fuel and an oxidant to the gasifier when the gasifier is at an intermediate temperature, wherein the intermediate temperature is sufficient to auto-ignite the start-up fuel within the gasifier, and wherein the start-up fuel comprises one or more hydrocarbons that are liquid at room temperature and pressure;

combusting at least a portion of the start-up fuel within the gasifier to produce a combustion gas; and transferring heat from the combustion gas to the gasifier to increase the temperature of the gasifier to the operating temperature;

directing a hydrocarbon feedstock to the gasifier when the temperature within the gasifier reaches the operating temperature;

combusting a portion of the hydrocarbon feedstock to produce a second combustion gas; and gasifying a portion of the hydrocarbon feedstock to produce a syngas.

* * * * *